US010431034B2

(12) United States Patent
Fan

(10) Patent No.: US 10,431,034 B2
(45) Date of Patent: Oct. 1, 2019

(54) ELEVATOR AND VENDING MACHINE USING SUCH ELEVATOR

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventor: Yong-Chang Fan, Wuhan (CN)

(73) Assignees: HONGFUJIN PRECISION INDUSTRY (WUHAN) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/859,335

(22) Filed: Dec. 30, 2017

(65) Prior Publication Data

US 2019/0088068 A1 Mar. 21, 2019

(30) Foreign Application Priority Data

Sep. 18, 2017 (CN) ..... 2017 1 0842754

(51) Int. Cl.
*G07F 11/16* (2006.01)
*G07F 11/42* (2006.01)
*G07F 11/60* (2006.01)

(52) U.S. Cl.
CPC ..... *G07F 11/16* (2013.01); *G07F 11/165* (2013.01); *G07F 11/42* (2013.01); *G07F 11/60* (2013.01)

(58) Field of Classification Search
CPC ..... G07F 11/16; G07F 11/165; G07F 11/42; G07F 11/60
USPC ..... 221/133
See application file for complete search history.

(56) References Cited

U.S. PATENT DOCUMENTS 5,143,193 A * 9/1992 Geraci ..... G07F 7/069 194/212
5,499,707 A * 3/1996 Steury ..... G07F 7/069 186/36
6,230,927 B1 * 5/2001 Schoonen ..... A61J 7/0084 221/10
6,597,970 B1 * 7/2003 Steury ..... G07F 11/16 414/268
6,755,322 B1 * 6/2004 Herzog ..... B65G 1/06 221/123
7,240,805 B2 * 7/2007 Chimomas ..... G07F 11/04 211/123
7,537,155 B2 * 5/2009 Denenberg ..... B65G 1/045 235/375
7,857,161 B2 * 12/2010 Pinney ..... G06F 19/3462 221/10

(Continued)

*Primary Examiner* — Rakesh Kumar
(74) *Attorney, Agent, or Firm* — ScienBiziP, P.C.

(57) ABSTRACT

An elevator for a vending machine and vending machine using the elevator work together, the vending machine includes a cabinet, a plurality of tiered pallets, and an elevator for delivering selected products from the pallets. Each pallet has a label. The elevator includes a driving unit and a storing box. The storing box includes a sensor for detecting the label. The storing box is fixed to the driving unit and driven by the driving unit, the storing box is slidable among the pallets, when a predetermined label is detected by the sensor, the storing box stops at that pallet and gently delivers product from that pallet.

7 Claims, 7 Drawing Sheets

(56) References Cited

U.S. PATENT DOCUMENTS

| | | | | |
|---|---|---|---|---|
| 8,061,555 | B2 * | 11/2011 | Guglielmi | G07F 11/007 194/212 |
| 8,162,174 | B2 * | 4/2012 | Hieb | G07F 11/165 221/122 |
| 8,556,119 | B2 * | 10/2013 | Skavnak | G07F 11/165 221/1 |
| 9,105,142 | B2 * | 8/2015 | Pinney | G06F 19/3462 |
| 2003/0201275 | A1 * | 10/2003 | Tamura | B65G 15/42 221/123 |
| 2019/0088068 | A1 * | 3/2019 | Fan | G07F 11/42 |

* cited by examiner

ELEVATOR AND VENDING MACHINE USING SUCH ELEVATOR

FIELD

The subject matter herein generally relates to vending machines using elevators.

BACKGROUND

Vending machine products, such as food products, should not be dispensed simply by being dropped to a delivery station. They should be delivered relatively gently so as not to be broken. Therefore, an elevator and vending machine using the elevator would be beneficial.

BRIEF DESCRIPTION OF THE DRAWINGS

Implementations of the present disclosure will now be described, by way of example only, with reference to the attached figures.

DETAILED DESCRIPTION

Figure 1:
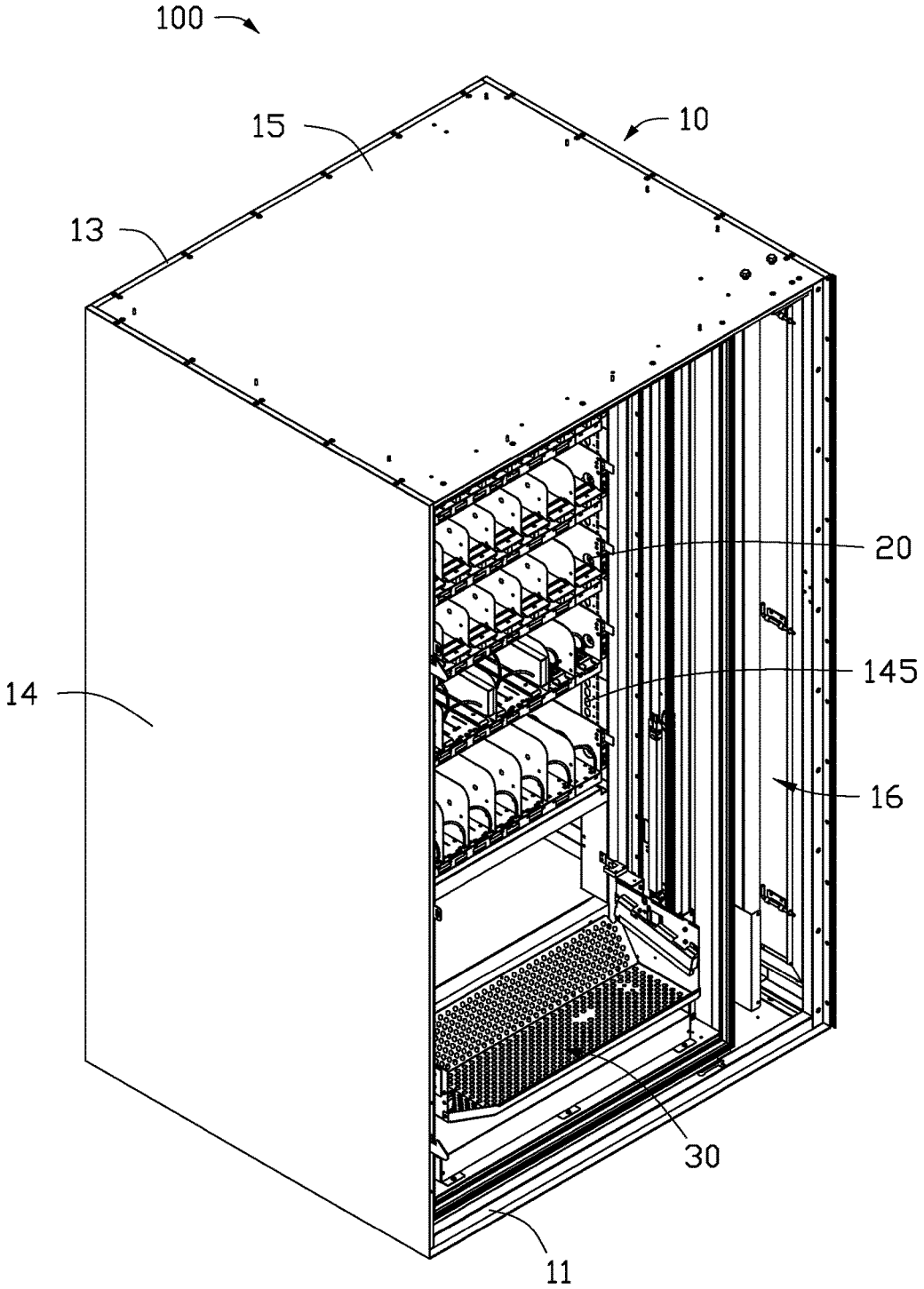
FIG. 1 illustrates an isometric view of an exemplary embodiment of a vending machine with an open panel.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

Several definitions that apply throughout this disclosure will now be presented.

The term "comprising" means "including, but not necessarily limited to"; it specifically indicates open-ended inclusion or membership in a so-described combination, group, series, and the like.

FIGS. 1 to 7 illustrate a vending machine 100. The vending machine 100 includes a cabinet 10, a plurality of pallets 20 and an elevator 30. The plurality of pallets 20 and the elevator 30 are accommodated in the cabinet 10. The pallets 20 are arranged in tiers.

Figure 2:
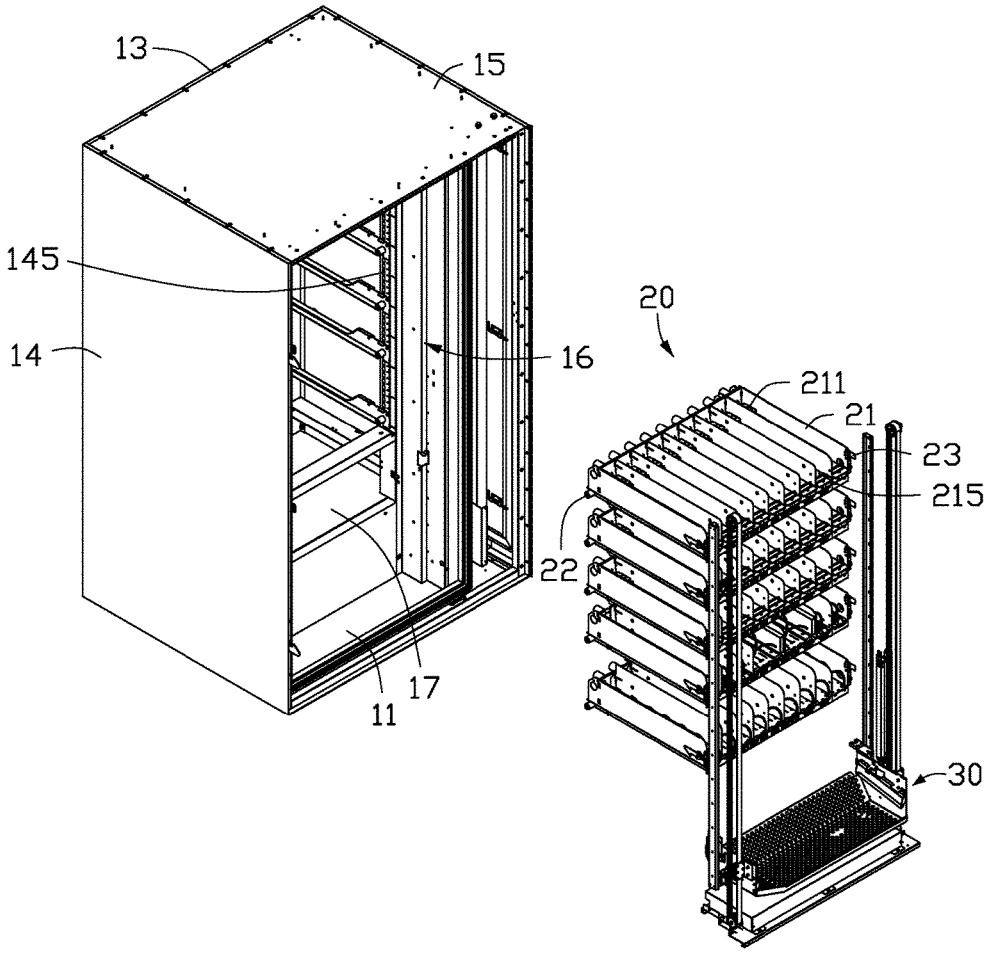
FIG. 2 illustrates an exploded view of the vending machine of FIG. 1, the vending machine including a plurality of pallets and an elevator.

Referring also to FIG. 2, the cabinet 10 may include a bottom plate 11, a rear plate 13 perpendicularly connected to a rear side of the bottom plate 11, two side plates 14, and a top plate 15 parallel with the bottom plate 11. The bottom plate 11, the rear plate 13, the side plates 14, and the top plate 15 define a receiving space 16. The plurality of pallets 20 and the elevator 30 are accommodated in the receiving space 16.

Each side plate 14 includes a holder 145, and the holder 145 may be used to support the pallets 20 and adjust the height of the pallets 20. The vending machine 100 may further include a refrigeration unit 17, and the refrigeration unit 17 may be received in the receiving space 16 to refrigerate products in the pallets 20.

Each pallet 20 defines a tunnel 21 for the products to pass through. An elastic member 211 is mounted to a rear end of the tunnel 21, and an opening 215 is defined in a front end of the tunnel 21. The elastic member 211 pushes selected products to pass through the opening 215.

Each pallet 20 may include a positioning pillar 22, and the positioning pillar 22 may be inserted into the holder 145 to secure the pallet 20 to the cabinet 10.

Each of the pallets 20 includes a label 23. The label 23 is located in a front side of the pallet 20.

Figure 3:
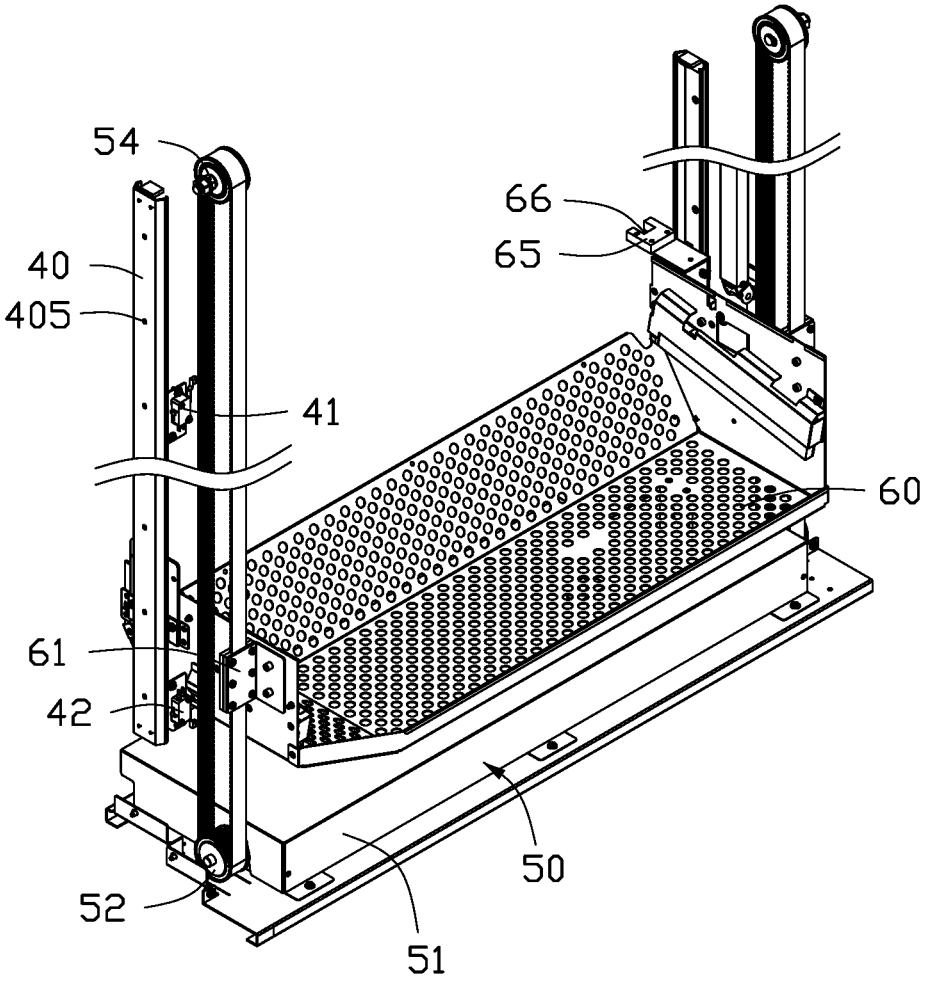
FIG. 3 illustrates an isometric view of an elevator of FIG. 2.
Figure 4:
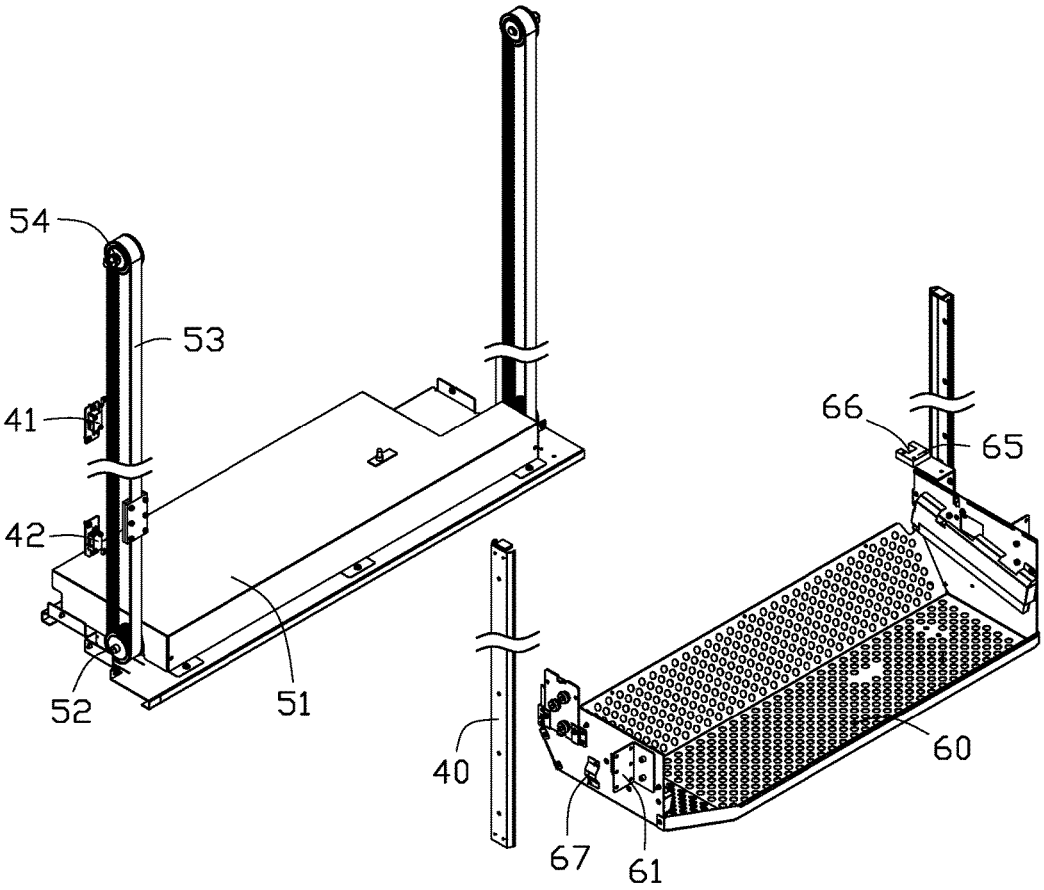
FIG. 4 illustrates an exploded view of the elevator of FIG. 3.

Referring also to FIGS. 3 and 4, the elevator 30 delivers products from the plurality of pallets 20, and includes two guiding rails 40, a driving unit 50, and a storing box 60. The two guiding rails 40 are parallel with each other. The storing box 60 is slidably connected to the two guiding rails 40.

The storing box 60 is secured to the driving unit 50 and is moved by the driving unit 50 relative to the plurality of pallets 20. When a predetermined label 23 is detected by the sensor 65, the storing box 60 is stopped at a pallet 20 having the predetermined label 23 to receive products from that pallet 20.

Each guiding rail 40 defines a plurality of mounting holes 405, and the guiding rail 40 is mounted to the side plate 14 by fasteners fixed in the mounting holes 405.

Each guiding rail 40 may include an upper end and a lower end. The guiding rail 40 includes an upper blocking member 41 at the upper end and a lower blocking member 42 at the lower end. The storing box 60 includes a convexity 67 corresponding to the upper blocking member 41 and the lower blocking member 42. The storing box 60 is blocked when the convexity 67 abuts the upper blocking member 41 or the lower blocking member 42.

The driving unit 50 may include a motor, a transmission shaft 52 rotatable by the motor 51, and a conveyer belt 53 driven by the transmission shaft 52. The storing box 60 is fixed to the conveyer belt 53 and driven by the conveyer belt 53.

The driving unit 50 may include a motor 51, a transmission shaft 52 driven to rotate by the motor 51, and a conveyer belt 53 driven by the transmission shaft 52. The storing box 60 is fixed to the conveyer belt 53 and driven by the conveyer belt 53.

The driving unit 50 may further include a pulley 54 mounted to an external member, an end of the conveyer belt 53 cup joints the transmission shaft 52, and another end of the conveyer belt 53 cup joints the pulley 54.

The storing box 60 includes a fixing member 61, and the storing box 60 is fixed to the conveyer belt 53 through the fixing member 61.

The storing box 60 may further include a sensor 65 for detecting the label 23. The sensor 65 defines a gap 66, and the label 23 is detected by the sensor 65 when the label 23 is located in the gap 66.

The sensor 65 may include a transmitting terminal configured to transmit signals and a receiving terminal configured to receive signals transmitted by the transmitting terminal. The transmitting terminal and the receiving terminal are distributed on opposing surfaces of the gap 66. When a label 23 is located in the gap 66, signal transmitting is cut off by the label 23 and thereby the sensor 65 detects the label 23.

Figure 5:
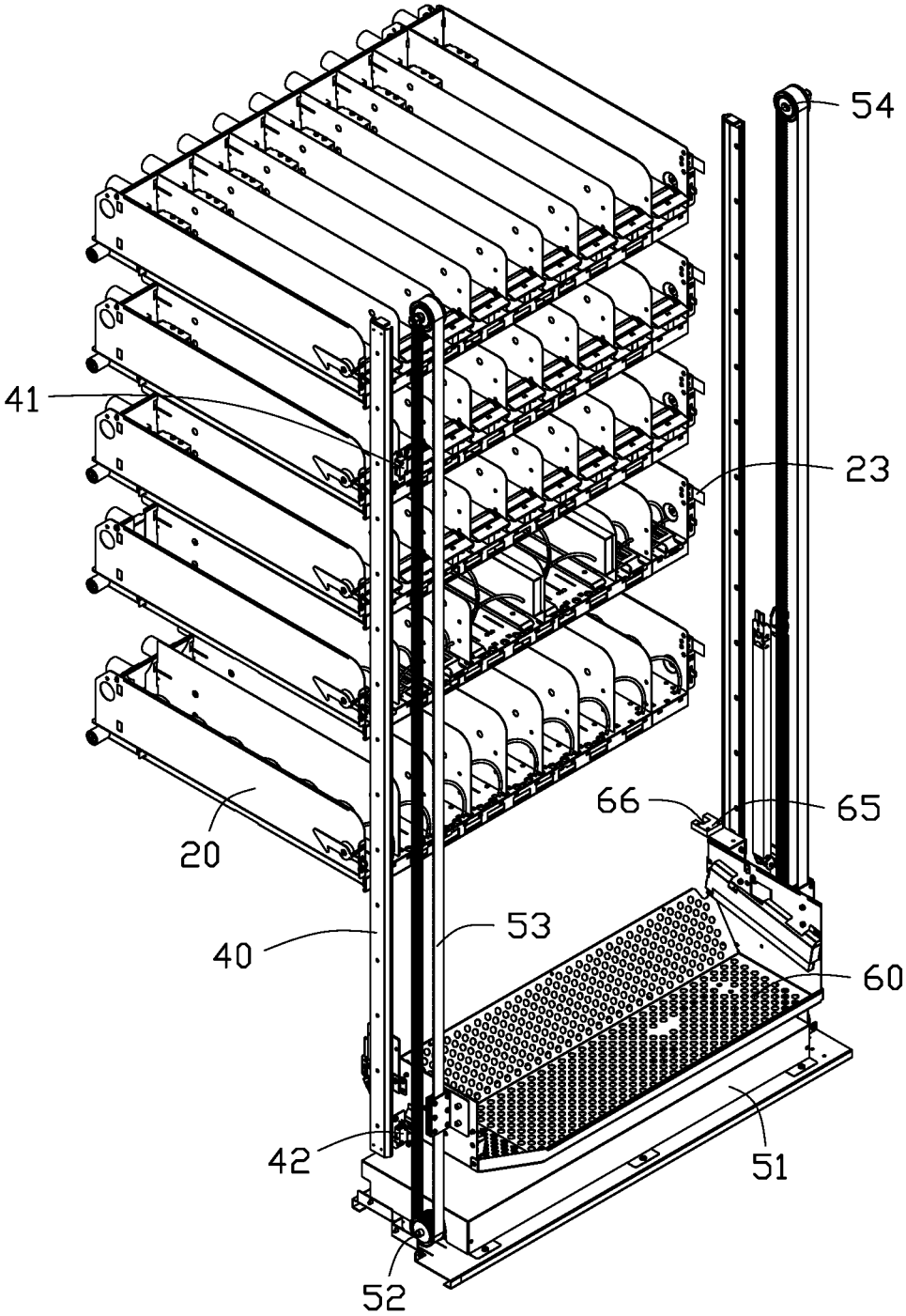
FIG. 5 illustrates an isometric view of the elevator and the plurality of pallets of FIG. 1, the elevator including a storing box in a first position.
Figure 6:
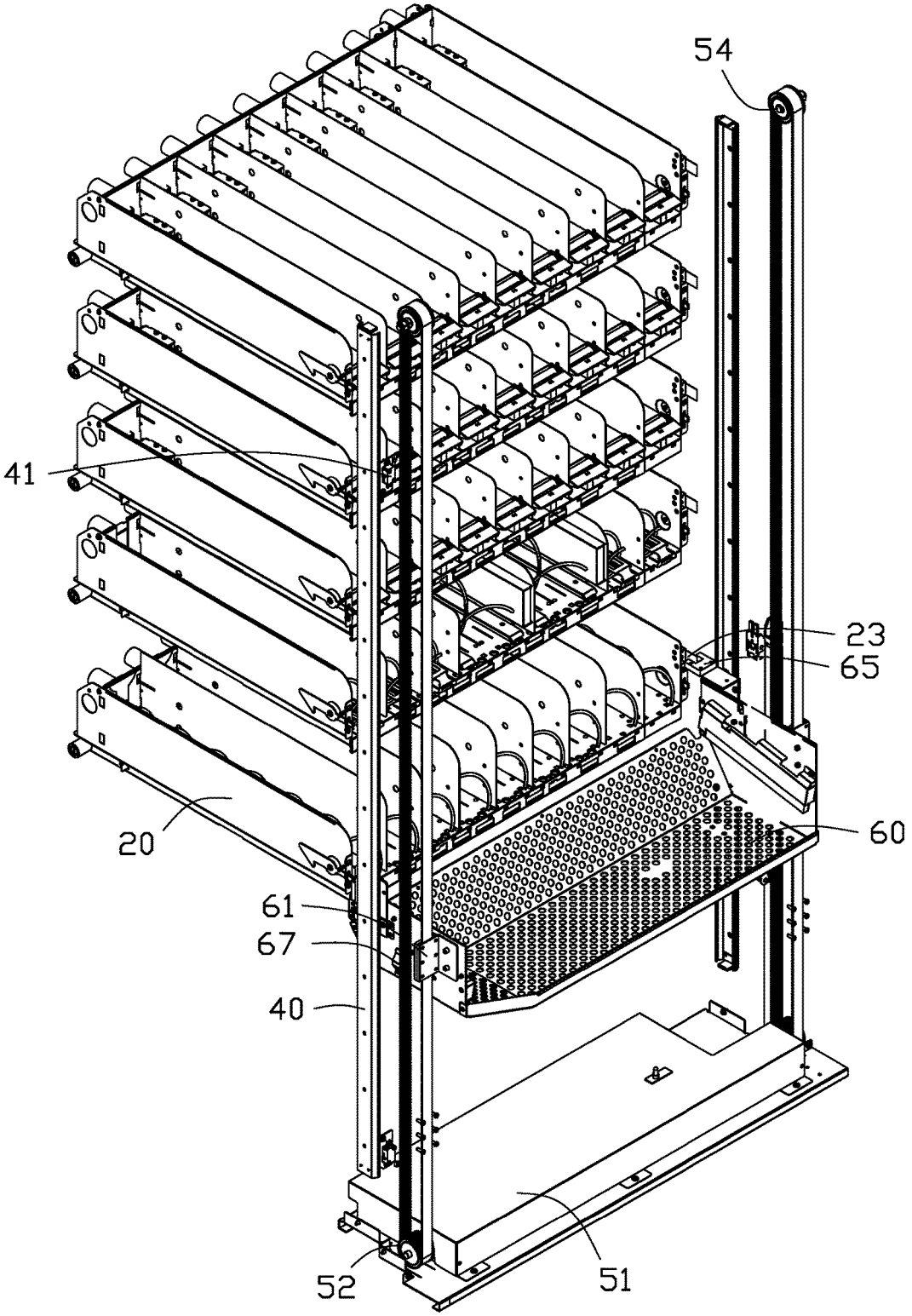
FIG. 6 is similar to FIG. 5, but shows the storing box in a second position.
Figure 7:
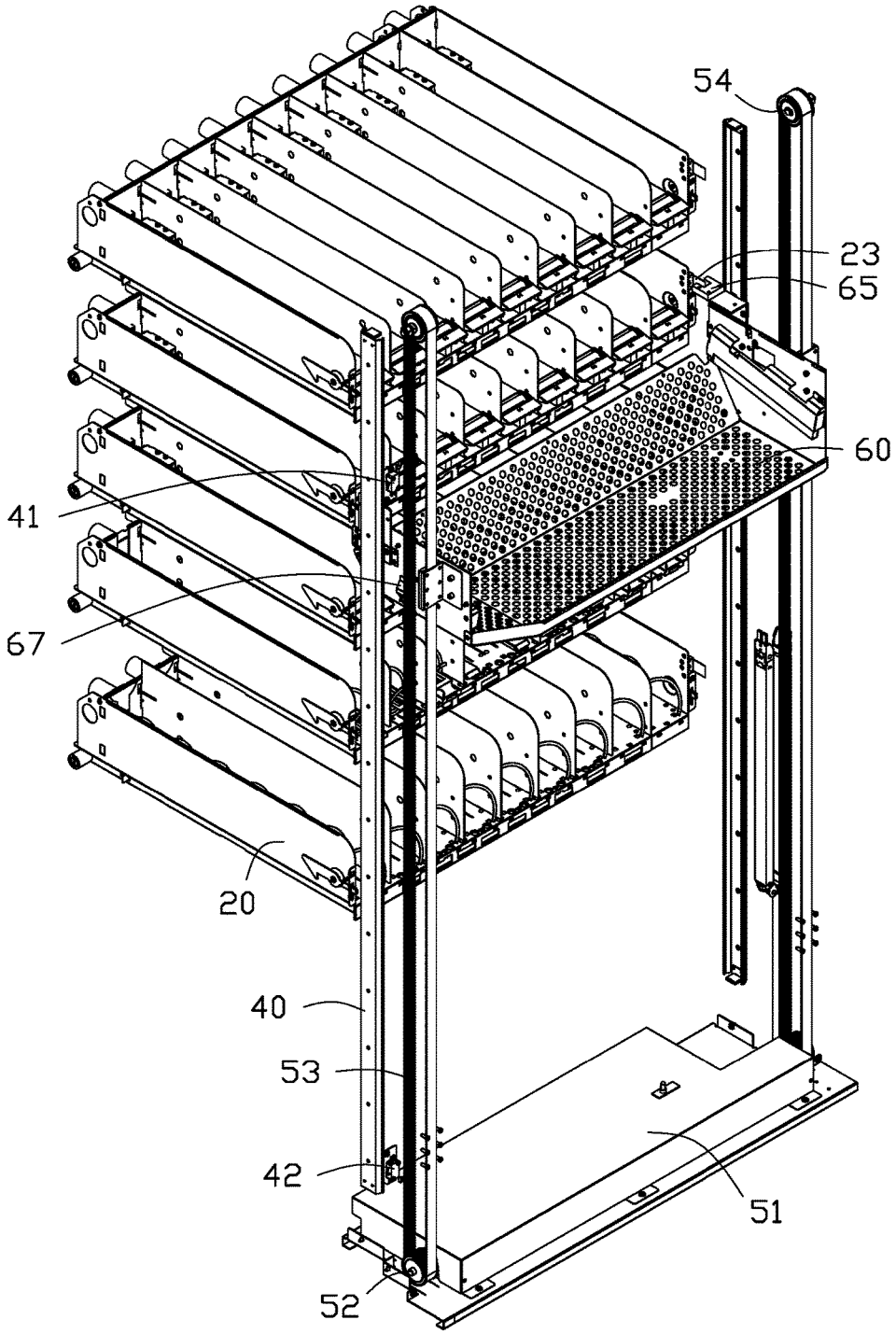
FIG. 7 is a similar to FIG. 5, but shows the storing box in third position.

Referring also to FIGS. 5 to 7, when the vending machine 100 is powered on, the elevator 30 is slid down to a bottom tier of the pallet 20. When the convexity 67 contacts the lower blocking member 42, the motor 51 is stopped.

When products of a tier N of the pallet 20 are chosen, the motor 51 drives the storing box 60 to slide upwards. When the sensor 65 detects a label 23, the sensor 65 counts one. When the sensor 65 counts to N, the motor 51 stops the storing box 60 to receive products in the tier N of the pallet 20. When the products are received by the storing box 60, the motor 51 drives the storing box 60 to slide downwards until the convexity 67 contacts the lower blocking member 42.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. An elevator, configured for delivering products from a plurality of pallets arranged in tiers, each of the plurality of pallets having a label, the elevator comprising:

a driving unit;

a storing box comprising a sensor configured for detecting the labels of the plurality of pallets; and a guiding rail, the storing box slidably connected to the guiding rail;

wherein the storing box is fixed to the driving unit and driven by the driving unit, the storing box is slidable relatively to the plurality of pallets, when a predetermined label is detected by the sensor, the storing box stops at a corresponding pallet having the predetermined label for receiving products from the corresponding pallet; and wherein the guiding rail comprises an upper end and a lower end, the guiding rail defines an upper blocking member at the upper end and a lower blocking member at the lower end; the storing box comprises a convex corresponding to the upper blocking member and the lower blocking member; and the storing box is blocked when the convex abuts the upper blocking member or the lower blocking member.

2. The elevator of claim 1, wherein the sensor defines a gap, and the label is detected by the sensor when the label is located in the gap.

3. The elevator of claim 2, wherein the sensor comprises a transmitting terminal configured to transmit signals and a receiving terminal configured to receive signals transmitted by the transmitting terminal, the transmitting terminal and the receiving terminal are distributed on two opposing surfaces of the gap; when a label is located in the gap, signal transmitting is cut off by the label and the sensor detects the label.

4. The elevator of claim 1, wherein the guiding rail defines a plurality of mounting holes, the guiding rail is mounted to external member through fasteners and the mounting holes.

5. The elevator of claim 4, wherein the driving unit comprises:

a motor;

a transmission shaft rotated by the motor; and a conveyer belt driven by the transmission shaft;

wherein the storing box is fixed to the conveyer belt and driven by the conveyer belt.

6. The elevator of claim 5, wherein the driving unit further comprises a pulley mounted to an external member, an end of the conveyer belt cup joints the transmission shaft, and another end of the conveyer belt cup joints the pulley.

7. The elevator of claim 6, wherein the storing box comprises a fixing member, and the storing box is fixed to the conveyer belt by the fixing member.

* * * * *